US007449105B2

(12) United States Patent
Hastings

(10) Patent No.: US 7,449,105 B2
(45) Date of Patent: Nov. 11, 2008

(54) WATER FILTRATION AND EROSION CONTROL SYSTEM

(75) Inventor: Denny Hastings, Shelbyville, TN (US)

(73) Assignee: Denny Hastings FLP 14, Shelbyville, TN (US)

( * ) Notice: Subject to any disclaimer, the term of this patent is extended or adjusted under 35 U.S.C. 154(b) by 0 days.

(21) Appl. No.: 11/800,891

(22) Filed: May 8, 2007

(65) Prior Publication Data

US 2008/0019780 A1 Jan. 24, 2008

Related U.S. Application Data

(60) Provisional application No. 60/831,835, filed on Jul. 19, 2006.

(51) Int. Cl.
*C02F 1/52* (2006.01)

(52) U.S. Cl. ..... 210/85; 210/170.03; 210/209; 210/484; 210/503; 210/505; 405/19; 405/74; 405/115; 405/302.6; 405/302.7

(58) Field of Classification Search ..... 210/170.03; 405/302.7
See application file for complete search history.

(56) References Cited

U.S. PATENT DOCUMENTS

| | | | | |
|---|---|---|---|---|
| 3,396,545 | A | 8/1968 | Lamberton | |
| 4,631,066 | A * | 12/1986 | Minemura et al. | 8/115.56 |
| 4,889,446 | A | 12/1989 | Holmberg | |
| 5,015,123 | A | 5/1991 | Houck et al. | |
| 5,154,543 | A * | 10/1992 | Houck et al. | 405/303 |
| 5,158,395 | A | 10/1992 | Holmberg | |
| 5,338,131 | A | 8/1994 | Bestmann | |
| 5,429,450 | A | 7/1995 | Meidinger | |
| 5,505,557 | A | 4/1996 | Bradley | |
| 5,669,732 | A | 9/1997 | Truitt | |
| 5,678,954 | A * | 10/1997 | Bestmann | 405/24 |
| 5,902,070 | A | 5/1999 | Bradley | |
| 5,951,202 | A | 9/1999 | Brown | |
| 6,109,835 | A | 8/2000 | Grabhorn | |
| 6,206,098 | B1 | 3/2001 | Cooper et al. | |
| 6,315,493 | B2 * | 11/2001 | Malone et al. | 405/45 |
| 6,464,428 | B1 * | 10/2002 | Mikell | 405/15 |
| 6,547,493 | B2 | 4/2003 | Spangler et al. | |
| 6,733,209 | B2 * | 5/2004 | Allard | 405/302.6 |
| 6,749,748 | B1 * | 6/2004 | Macpherson et al. | 210/198.1 |
| 7,178,224 | B2 * | 2/2007 | Bussey et al. | 29/728 |
| 7,226,240 | B2 * | 6/2007 | Tyler | 405/19 |

(Continued)

OTHER PUBLICATIONS

Int'l Search Report, Jan. 24, 2008, Denny Hastings.

*Primary Examiner*—Peter A. Hruskoci
(74) *Attorney, Agent, or Firm*—McNair Law Firm, P.A.; William D. Lee, Jr.

(57) ABSTRACT

An erosion control system and method wherein a fabric filter bag is embedded with and/or filled with a flocculating polymer and is positioned on a sloping soil surface to dam and pond water flowing thereacross for settling of the particles in the water, and as the ponding water seeps into the bag the colloidal particles will be filtered or agglomerated for settling. The water then passes through and out of the bag and is further subjected to agglomeration and filtering by a skirt of filter material also impregnated with flocculating polymer, said skirt being anchored to the bag or stacked to maintain the position adjacent and downslope from the bag.

13 Claims, 11 Drawing Sheets

U.S. PATENT DOCUMENTS

| | | | | |
|---|---|---|---|---|
| 7,303,670 | B2 * | 12/2007 | McPhillips | 210/170.03 |
| 2004/0005198 | A1 | 1/2004 | Spangler et al. | |
| 2004/0133176 | A1 | 7/2004 | Muthiah et al. | |
| 2006/0060512 | A1 * | 3/2006 | Astle et al. | 210/85 |
| 2006/0075619 | A1 | 4/2006 | Bussey, Jr. et al. | |

* cited by examiner

WATER FILTRATION AND EROSION CONTROL SYSTEM

CROSS REFERENCE TO RELATED APPLICATION/CLAIM OF PRIORITY

This application claims priority under 35 USC §120 from U.S. provisional application Ser. No. 60/831,835 filed Jul. 19, 2006 entitled "Polymer Filtration System and Method for Erosion Control and Water Clarification".

FIELD OF THE INVENTION

This invention relates to a system and method for capturing particles in runoff water from sites undergoing grading, landscaping, mining maintenance, logging, road building, land fills, utility and building construction, and other types of soil and environmental disturbances and for controlling erosion at such sites. The erosion control method of the invention is also useful for controlling flash flooding in flood prone areas, in areas subject to hazardous fires, in areas requiring industrial waste management and in containing environmental spills and nuclear wastes. The invention particularly relates to a system and method employing filters, settling, and polymeric removal of solids and suspended particles in the water run-on and runoff.

BACKGROUND OF THE INVENTION

In the development of subdivisions and shopping centers, in urban expansion, and in road and highway construction, huge quantities of earth often must be either removed or disturbed leaving large areas of exposed land without any cover or means to prevent erosion. Not only do good environmental practices require erosion control but so do many local, state, and federal laws and regulations.

In addition to requiring control of the quantity and flow of water from sites being developed, the quality of the water is also subject to regulatory requirements that grow more stringent each year. These stringent storm water regulations require more than conventional silt fencing products and straw bales. The Clean Water Act is changing the face of erosion control devices. Noncompliance with the National Pollutions Discharge Elimination System, Phase II Storm Water Regulations, implemented in 2005, is subject to administrative orders, civil actions, and/or criminal prosecutions on federal, state, county and municipal government levels. All states review their erosion and sediment control manuals to reflect new information on best management practices, and many are requiring that erosion and sediment control practices meet a minimum performance standard. Most of the prior products do not provide compliance with the new act. As examples of a few of the many prior art processes and products for erosion control reference is made to U.S. Patent Application Publication no. 2004/0005198A1 and no. 2004/0133176A1.

Accordingly, an important object of the present invention is to provide an erosion control and water clarification system and method that exceed the new standards for storm water run-off.

Another object of the present invention is to provide compliant erosion control and water clarification and filtration systems that can be quickly installed and removed, require limited site preparation or staking, and are low maintenance during and after installation, and result in improved water flow.

Another object of the present invention is to provide compliant erosion control and water clarification products that are easily configured to the landscape, contour, or lay out of the site and conform effectively to the soil, sand, rock, and paved surfaces at the site to provide superior soil confinement with minimal land disturbing activity. However, the invention may also be used where there has been no land disturbance and it is desirable to control surface water flow.

Still another object of the present invention is to provide an effective erosion control method and means that can be readily used in a wide variety of applications.

SUMMARY OF THE INVENTION

The above objectives are accomplished according to the present invention which removes unwanted contaminants from run-off water and in one aspect sequentially employs the steps of settling, filtering, and agglomerating particulate matter in run-off water. In one aspect this is accomplished by providing an erosion control system comprising a plurality of elongated, closed filter bags constructed from a filtration fabric. The bags act as a dam to pool water for settling and, as water seeps through the bags, the bags also act as a filter to remove soil particles. A polymeric material is preferably disposed within the filter bag for agglomerating colloidally suspended particles in water passing through the bag wall from the dammed up pool whereby the agglomerated particles settle within the filter bag and remain.

In another aspect, after passing through a filter bag the water encounters a skirt or apron of filter material that is also impregnated with an agglomerating polymer to further group suspended particles together so that they will settle out. The skirt is positioned down slope from the bag and may be attached to the bag for stable positioning as the terrain dictates.

In yet another aspect the present invention employs a polymer system that includes a special formulation of a blended water-soluble anionic polyacrylamide dry powder product referred to hereinafter as "PAM" that is used to minimize soil erosion caused by water and wind. There are other flocculants or agglomeration promoters that are known and have been used in water treatment for a long number of years. Alum, gypsum and chitosan have been used but PAM has been found especially useful in erosion control. PAM decreases soil sealing by binding soil particles, especially clays, to hold them on site. In addition, these types of products may also be used as a water treatment additive to remove suspended particles from runoff. This system is designed as a more effective replacement of prior art velocity dissipating devices such as the conventional siltation fence product, baffle units, and other tube type products currently in use today.

Water clarity is achieved primarily by particle reduction or removal, that is, by removing the suspended particulate matter. Particulate matter which can be removed by normal gravitational settling is classified as a settleable solid. These solids are removed by reducing the velocity of the water to a "ponding" state that will allow settling to take place. The filter bag units act first as a dam to create a pond or pool by retarding the flow of water and sediment thereby allowing time for sedimentation of suspended particles. This takes place on the influent side of the bag and is a first step in the process of the invention. The present invention provides a unique combination of three water treatment phases of settling, agglomeration, and filtering. In one aspect, the bag of the present invention can perform all three phases. Agglomeration and filtering may be looked at as methods of "capturing" unwanted particles.

The suspended particulate matter which does not settle during the ponding phase from gravitational settling or is not removed by the filtering effect of the bag wall material is considered to be colloidal. Colloidal particles maintain a negative ionic charge and do not have enough mass to settle. These are the particulates that cause the water to appear turbid or opaque. The effective removal of these colloids can be greatly enhanced through the introduction of a polymeric agent to the turbid water. These agents collectively bond naturally suspended particles together causing them to gain sufficient weight to settle out of suspension through gravitational sedimentation. The preferred agent, PAM, is placed within a filter bag in powder form without mixing or it may be mixed with the ballast. Water flow through the bag is relatively slow giving the agglomerated particles time to settle. In the bag, water is absorbed into or is trapped in the ballast if the ballast comprises materials that tend to absorb water such as mulch, wood chips, saw dust, cotton seed hulls, pecan shells and/or other natural, organic, vegetable materials. In addition, the ballast may comprise synthetic material such as synthetic foam shavings, synthetic fibers such as shredded polyester cord reclaimed from rubber tires, or ground rubber, and comprise inorganic materials such as gravel or crushed stone. The ballast preferably is a combination of the synthetic and organic materials. The water trapped within the ballast greatly increases the bag weight and its stability on a slope.

Soil types can vary greatly depending on variables such as type of clay, humus, and soil pH. Due to these variations, on-site soil testing and evaluation is a recommended procedure. For example, the site may be one where coal slurries, mine trailings, or waste petroleum products are present. The soil test will determine the correct dosage amount and polymer system to be recommended and selected. By ensuring the correct dose and type of polymer, greater water clarity can be achieved through a prescribed formulation.

Water that passes through the bag may still contain colloidal particles. In a preferred embodiment, as this water leaves the bag it contacts the mesh skirt that is impregnated with PAM to induce further agglomeration of the suspended particles. The mesh may be jute, cotton, or other suitable organic or inorganic material. In addition to exposing the run off water to the PAM, the skirt also retards water flow and is a backup to restrain and prevent any breakthrough of higher velocity water streams in a heavy downpour. As the particles settle they may settle directly on the surface soil. These sediments tend to increase flocculation thus increasing the pore volume of the soil which reduces the quantity of water run-off while increasing its quality. For further erosion control, grass or other ground cover seed can be attached to the skirt. Also, additional skirts may be provided downslope to ensure a high level of erosion control. In one aspect, a skirt in and by itself may perform the erosion control functions of agglomerating and filtering. Skirts may be placed on steep inclines and used as ditch liners.

In another aspect, the ballast which is disposed within the filter bag with the polymeric material to filter water passing through, restrains movement of the filter bag when placed on a surface across which water may flow. The ballast enables the filter bag to remain where positioned and effectively dam water flow for a time sufficient to promote settling as well as filtering the water passing through the bag.

Preferably, the ballast filter material may comprise the materials mentioned above and the fabric, preferably, a polymeric material, may be a woven polypropylene, and the polymeric material may comprise a water soluble anionic polyacrylamide (PAM).

Advantageously, the filter bag is in the shape of a tube with closed ends wherein the diameter of the tubular filter bag is in the range from about 8" to about 12". The bags are marketed under the trademark "EROSION EEL"™ owned by Denny Hastings FLP14, a family Limited Liability Company of Nevada. A tube shape is one very useful configuration but the bag may also be multi-sided or gusseted. The filter bags are stackable; one upon another, and/or the fabric preferably comprises a non-toxic, flame retardant polymeric material. A UV inhibitor as well as a flame retardant is included in the skirt and bag material.

In another aspect of the invention, a method of controlling erosion is provided comprising the steps of forming elongated filter bags from woven fabric having weave openings of a size that will filter the sediment from the water passing through the fabric openings and at least partially filling the filter bag with a ballast material that also filters the water. The method comprises disposing an agent within the filter bag for agglomerating colloidal particles suspended in water passing through the filter bag and closing the filter bag to enclose the ballast and the agglomerating material. The filter bags, when positioned on a surface with a skirt, control the flow of water across the surface. Advantageously, the ballast material is selected as mentioned above to provide sufficient weight for stabilizing the movement of a filter bag on the surface upon which it is placed. The fabric of the bag may comprise a sealable material and the filter bag may be formed and closed in a form-fill-seal process. A pre-formed bag may be filled on site by gravity feed, or by mechanical means such as by pumping or blowing the ballast into the bag on site. While on-site filling is possible it has proven to be impractical, because the ballast does not blow or pump readily without clogging as a bag is filled and it is inconvenient to mix ballast on site. A preferred method is described below.

The fabric of the filter bags has uniform openings to provide a constant level of filtration and sediment control over the life of the product and to provide handling of higher flow rates while being easily cleaned if needed. The filter bag units and skirts may be easily transported or moved temporarily for ingress or egress activity, or for installation on the most difficult to reach job sites. Through installation designs and the ability to stack the filter bag units, a multitude of erosion control designs can be achieved. Bags can be rotated and cleaned by rain water or removed and mechanically cleaned on or off site. The skirt which is attached underneath or to the down hill side of the bag is laid parallel to the bag. It may comprise the same material as the bag or may be jute or cotton mesh impregnated with PAM or other agglomerating agent.

In a further aspect, the invention is a method of making the elongated filter bag comprising the steps of mixing predetermined quantities of 1) organic materials which may include, for example, hardwood chips, straw, cocoa shells, ground corn cobs or cotton seed hulls; 2) recycled shredded rubber or foam rubber shavings or from tires; 3) synthetic, organic, or mineral fibers which may include carpet shavings; and 4) a chemical agglomerating agent to form a filler mixture. These steps are preferably performed with the assistance of a conveyor. The mixture is agitated so that it flows freely, and is then deposited by gravity into vertically positioned, fabric tubular-shaped bag with one open end, and then the tubes or bags are closed and removed after filling. The filled bags are now ready for positioning for erosion control.

In a still further aspect, the bags may be equipped with RFID tags, i.e., radio frequency, identification devices making required periodic inspection of sites easier and more complete. The RFID device may record each time an inspector with a transmitting and recording device of the appropriate range and frequency has been at the site to make an inspection. Likewise, the inspector will be able to tell if all bags remain at the site and are intact. Reports may be readily generated in this manner. Also the length of time a bag has been installed can be monitored since, at present, 24 months is the projected effective lifetime of a bag.

In yet one additional aspect, the present invention is a method of controlling erosion on a sloping surface having soil susceptible to erosion comprising the steps of providing a filtering fabric with an agglomerating or flocculating polymer embedded therein; forming a shaped article from said fabric, and securing said article to said sloped surface. The article may be a bag or tube or skirt and the means for securing the article may be ballast in the case of a bag or attaching the skirt to another article or by staking it. The skirt may also be a receptacle that, when essentially flat, may be filled with ballast. The article may also be secured by its own weight and the adhesive properties that develop with the contact of the polymer with the soil.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Referring now in more detail to the drawings, the invention will be described in more detail.

Figure 1:
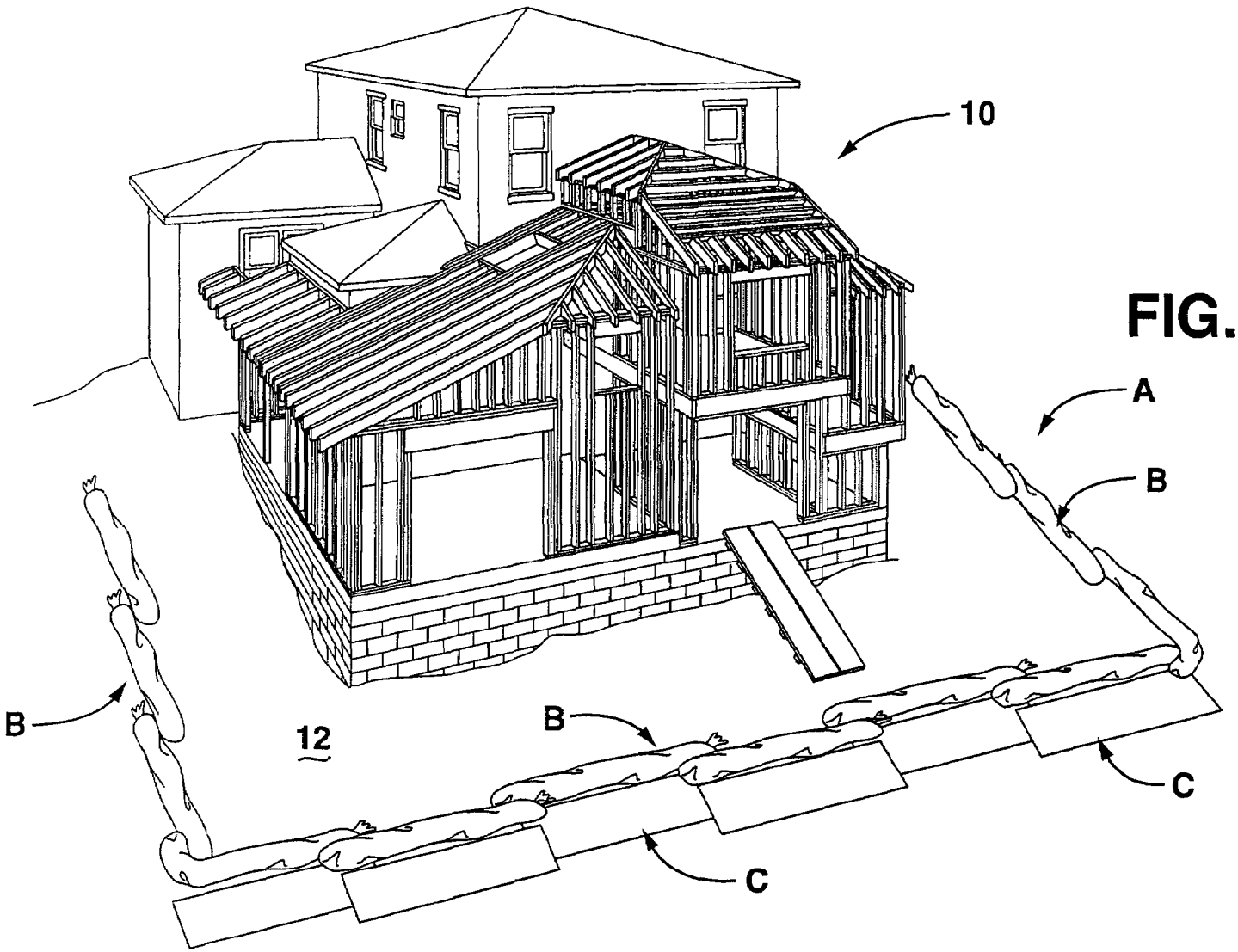
FIG. 1 is a front perspective view illustrating a polymer filtration system and method for erosion control and water clarification at a construction site according to the present invention.
Figure 2A:
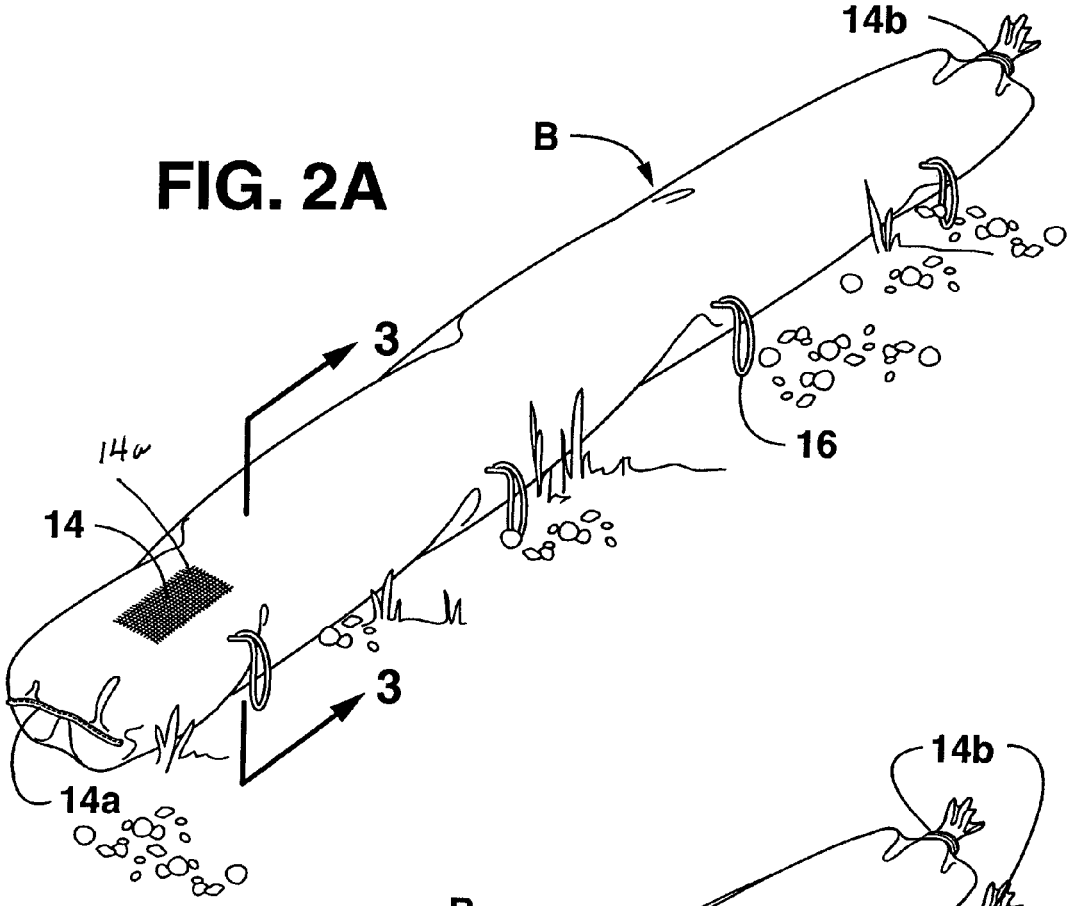
FIG. 2A is a filter bag of a polymer filtration system and method according to the invention.
Figure 2B:
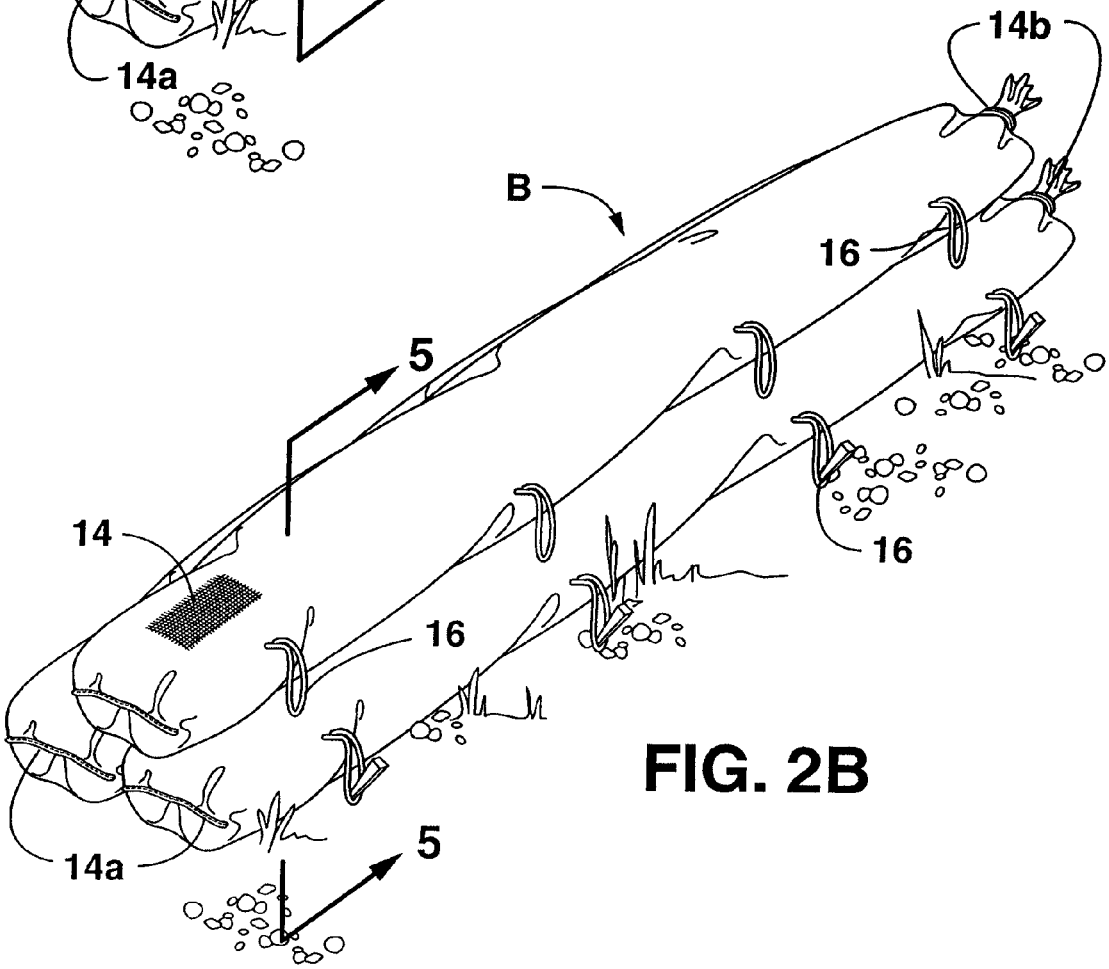
FIG. 2B is a plurality of filter bags stacked to provide greater erosion control in a polymer filtration system and method according to the invention.
Figure 9A:
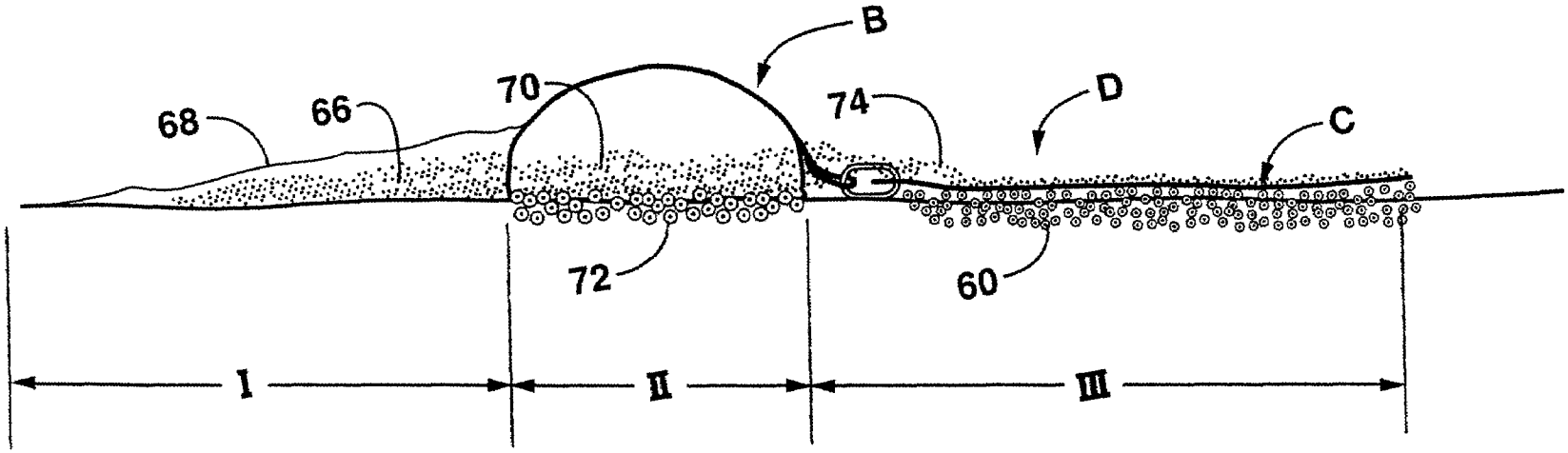
FIG. 9A is a representation of an elevation section of the view of FIG. 8 showing Phase I, Phase II, and Phase III of a system and method according to the invention for erosion control and water clarification.
Figure 9B:
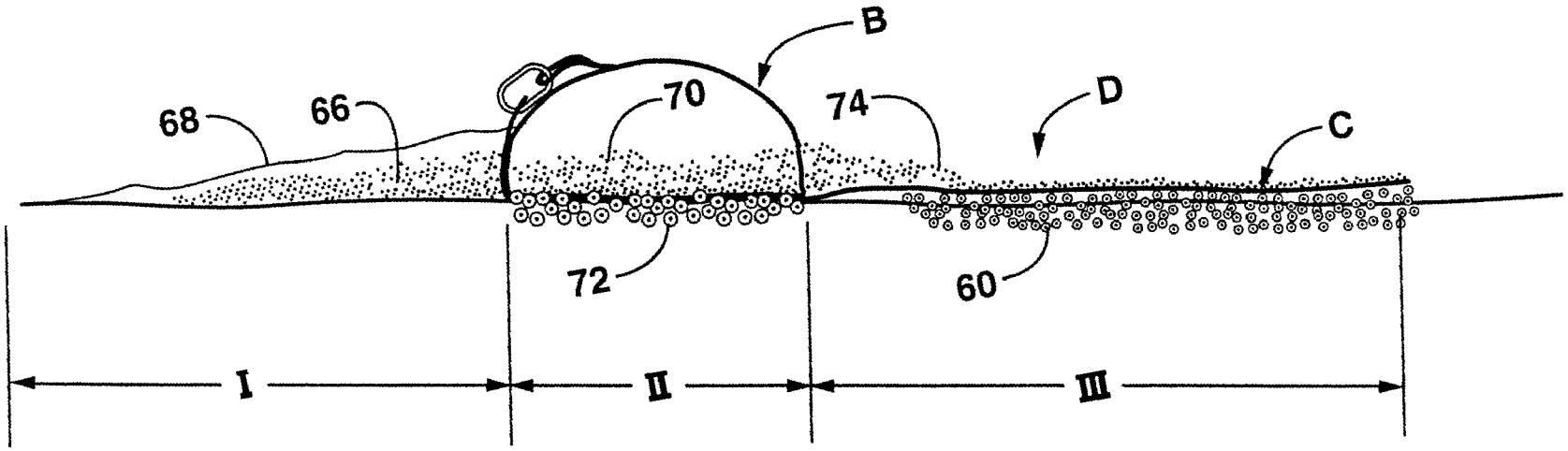
FIG. 9B is the representation of FIG. 9A wherein the skirt of the present invention is wrapped partially around the bag for further stability on a sloped surface.

FIG. 1 illustrates a simple job site of a residential home 10 having a downward slopping lot 12 which is provided with an erosion control and water clarification system, designated generally as A, employing an arrangement of filter bags, designated generally as B. The front row of filter bags B includes water clarification skirts C. The same may also be provided on the side row of filter bags, if desired. As can best be seen in FIG. 2A, filter bag B includes a filter fabric 14 formed into an elongated, tubular filter bag B. For example the bag tube may be formed with a longitudinal seal, or two side seams and the seams may be sewn, thermal or adhesively bonded, and the like. In some instance, a seamless woven tube may be used. One end of the bag, 14*a* is closed and the other end of the bag 14*b* may be opened for filling and then closed by any suitable means. The bag may be provided with a plurality of straps 16, or other means so that the bag may be handled for installation, movement, and removal. While filter bag B may have many designs depending on the desired application, the filter bag is preferably in the range of 3 to 20 feet with 3 to 12 feet being most preferred. In the preferred embodiment, the filter bag may be provided with four handle straps 16 that allow it to be easily moved. Filter bags can range from 4 inches to 20 inches in diameter, with a preferred diameter being in the range of 8 to 12 inches. In the preferred range of length and diameter, the filter bag will weigh less than 125 pounds when dry with optimum weight being in the range of 100 to 125 pounds when dry. The fabric 14 has openings 14*a* of a size that passes water but filters out settleable solids 66 (FIGS. 9A and 9B). FIG. 2B illustrates the stacking of three or more filter bags to provide increased erosion control and water clarification. The ballast material may be an organic material such as mulch, wood chips, crushed stone, saw dust, cotton seed hulls, pecan shells or an inorganic material such as ground rubber, or synthetic foam shavings and/or any other suitable materials or combination of materials. The most suitable mulch material would be a first grind hardwood chips having mulch pieces of three quarter inch to two inches meeting AASHTO (American Association of State Highway and Transportation Officials) certification for use on unvegetated filter barrier installation. In a preferred embodiment a rubber ballast is utilized wherein the rubber pieces are in the range of one eighth to two inches with less than three quarter inches being preferred. The filter fabric may be woven, knitted, or non-woven. If woven, the filter fabric may be woven flat or tubular. The weave pattern may be double twisted twill, square weave, or plain. Knitted fabric may be knitted circular, flat, or with a weft insertion. Non-woven fabric may be needle punched, wet laid, spun bond, spun laced, or melt blown. Stitch bonded fabric, laminated, or a fabric combination utilizing two or more of the technologies may be used. Preferably, the fabric material is a polymer such as polyester, nylon, polyolefin, or organic fibers such as jute, cellulose, etc. Other parameters of fabric 14 and filter bag B are shown below.

| Mechanical Properties | Test Method | Units | Typical Values MD | Typical Values CMD | Design Range MD | Design Range CMD |
|---|---|---|---|---|---|---|
| Grab Tensile | ASTM D 4632 | lbs. | 400 | 250 | 50-600 | 25-600 |
| Grab tensile Elongation | ASTM D 4632 | % | 15 | 6 | 0-50 | 0-50 |
| Trapezoid Tear Strength | ASTM D 4533 | lbs. | 170 | 110 | $50^+$ | $30^+$ |
| Mullen Burst Strength | ASTM D 3786 | psi | 800 | | $200^+$ min. | |
| Puncture Strength | ASTM D 4833 | lbs. | 180 | | $60^+$ min. | |
| Flow Rate | ASTM D 4491 | gal/min/$ft^2$ | 40 | | 20-80 | |
| Permeability | ASTM D 4491 | cm/sec | 0.05 | | 0.05 +/− 33% | |
| Permittivity | ASTM D 4491 | sec−1 | 0.52 | | 0.05 +/− 33% | |
| Apparent Opening Size (AOS) | ASTM D 4751 | mm/US Sieve | mm 0.600 | US SIEVE (30) | mm 0.300-0.850 | US SIEVE 20-50 |
| UV Resistance (500 hours) | ASTM D 4355 | % Strength retained | 70 | | $50^+$ | |
| Flame Resistance | | GRADE "E" | | | YES | |
| Ounce Weight | | oz/sy | 8.0 | | 2-20 | |

Figure 3:
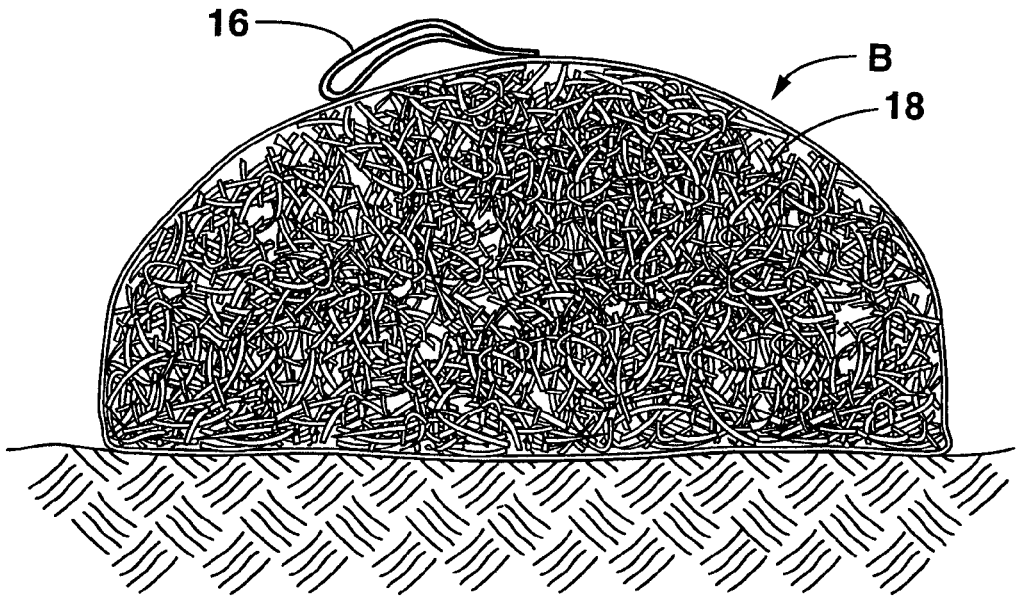
FIG. 3 is a sectional view taken along line 3-3 of FIG. 2A.
Figure 4:
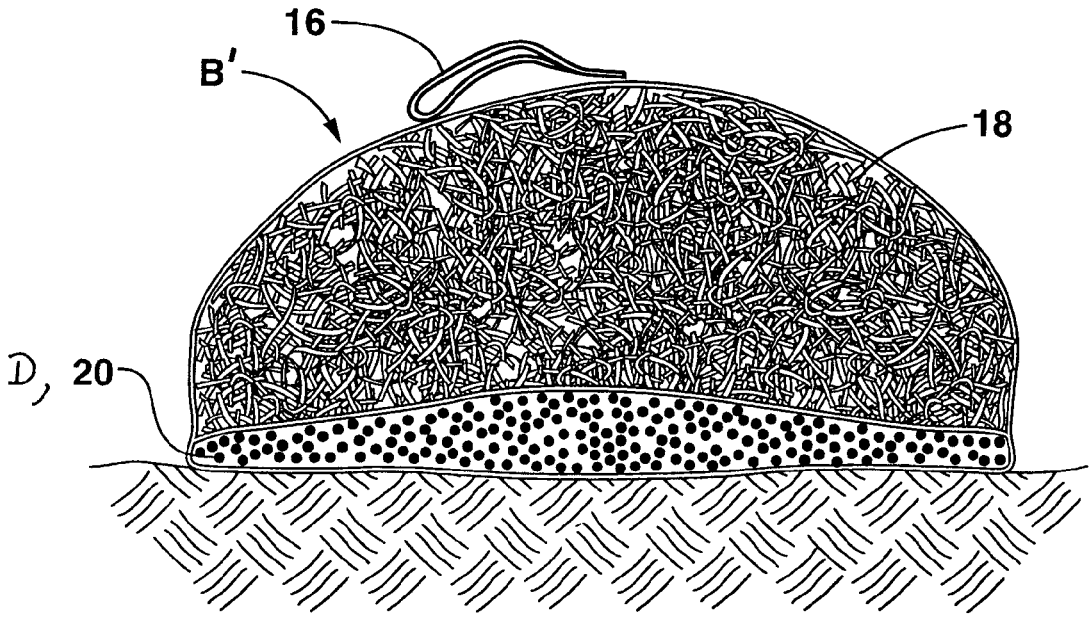
FIG. 4 is a sectional view similar to FIG. 3 illustrating an alternate embodiment of a filter bag according to the invention.

As can best be seen in FIGS. 3-5B, filter bag B includes a ballast material 18 to provide the filter bag with sufficient bulk and weight to assist in maintaining the filter bag in place. In this embodiment PAM may be uniformly distributed in the ballast material. FIG. 4 shows an alternate embodiment wherein anionic polyacrylamide material at 20 is added to the bottom of the filter bag for removing suspended particles in the water to clarify and filter the runoff in a manner to be more fully described hereinafter. The effect of the reaction of the PAM and the soil is that the skirt and the bag will be chemically bonded to the ground.

The composition of ballast 18 is preferably selected for the major contaminant to be removed. For removal of suspended soil particle or coal in coal slurries a mixture of approximately equal parts on a volume basis of inorganic, organic and synthetic material is preferred. Virtually 100% synthetic material is desirable where absorption of contaminant particles may be desired e.g. chemical contaminant, mine trailings etc. may require different ratios and materials depending on the contaminant. Thus, selection of the ballast composition will preferably be matched to the contaminant to be removed.

Figure 5A:
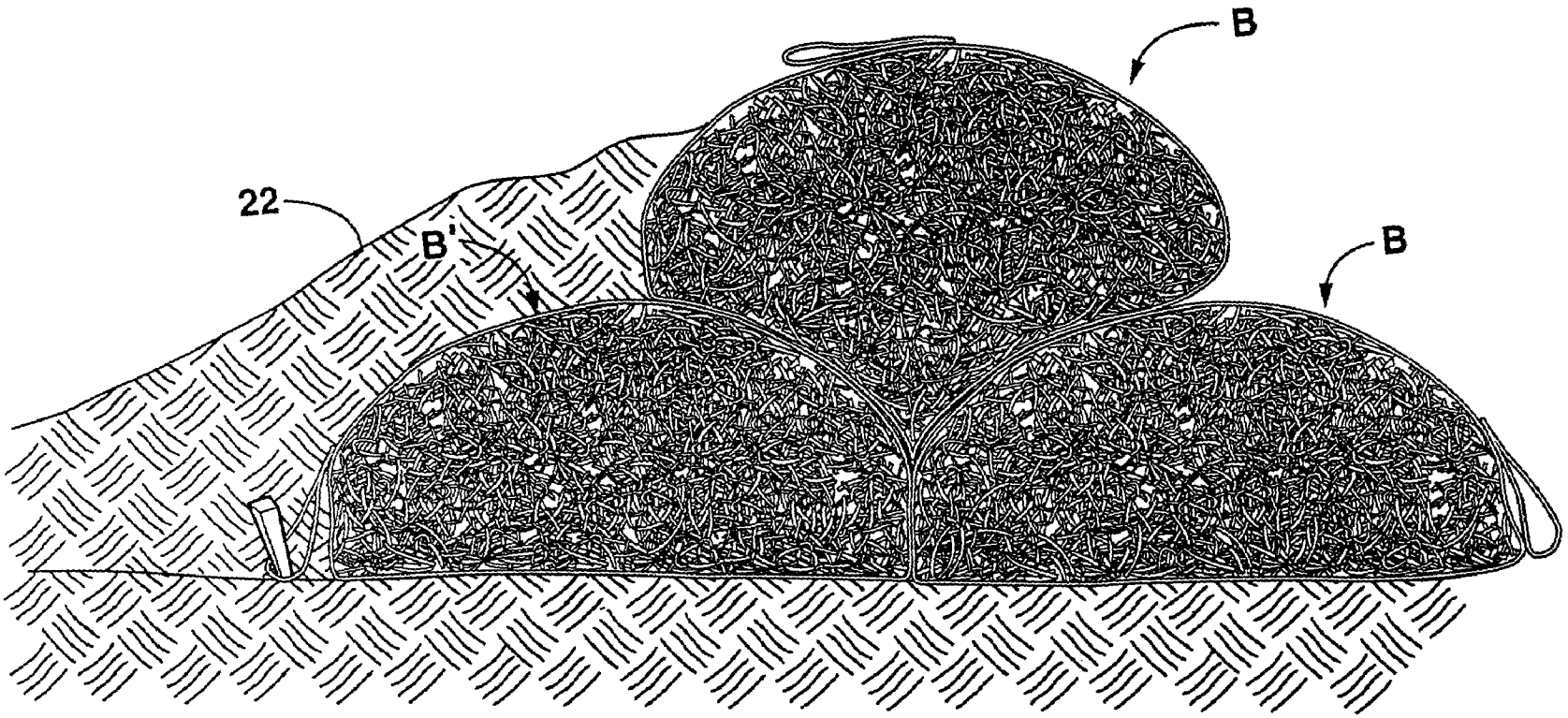
FIG. 5A is a sectional view taken along line 5-5 of FIG. 2B.

FIG. 5A is a sectional view taken along line 5-5 of FIG. 2B where three of the filter bags are arranged in a stacked configuration for greater erosion control protection. According to the invention, soil and sedimentation 22 backs up behind the filter bags as the filter fabric slows and allows the water to flow through the ballast material in the bag.

Figure 5B:
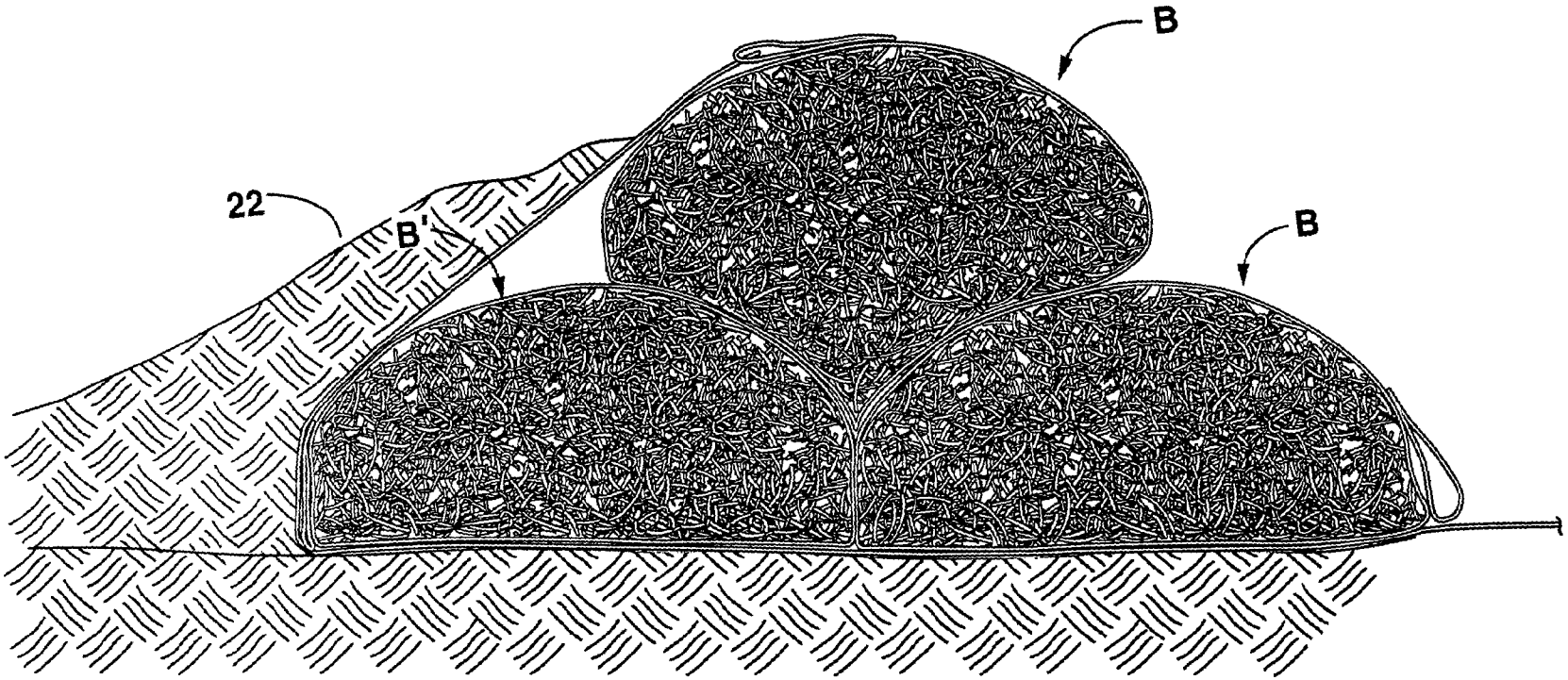
FIG. 5B is the view if FIG. 5A with a portion of the skirt of the present invention wrapped around the stack of bags.

It will be noted in FIG. 5A that the ballast and PAM treated fabric allows the filter bag to adhere flat and close to the ground so that only a minimal amount of water is diverted underneath the filter bag. The drape also allows the stacked bags to fill in between each other effectively. Of course any number of the filter bags can be stacked depending upon the need and application being made. FIG. 5B illustrates an alternate embodiment wherein a skirt is attached at the strap or loop on the top of the uppermost bag and is wrapped around the left side of the stack of bags and continues under the bags to the lower right side. This "wrap" serves to stabilize the stacked bags and the skirt.

Figure 6A:
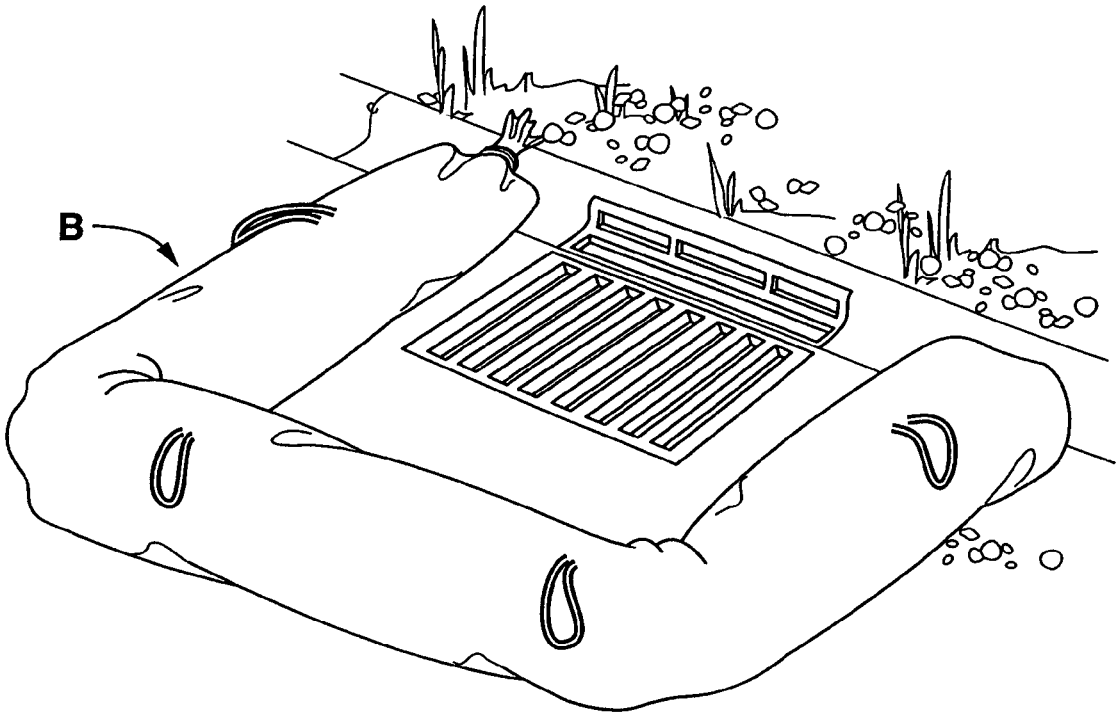
FIG. 6A is a view illustrating an application of a filter bag according to the invention for protecting a street and curb drain.
Figure 6B:
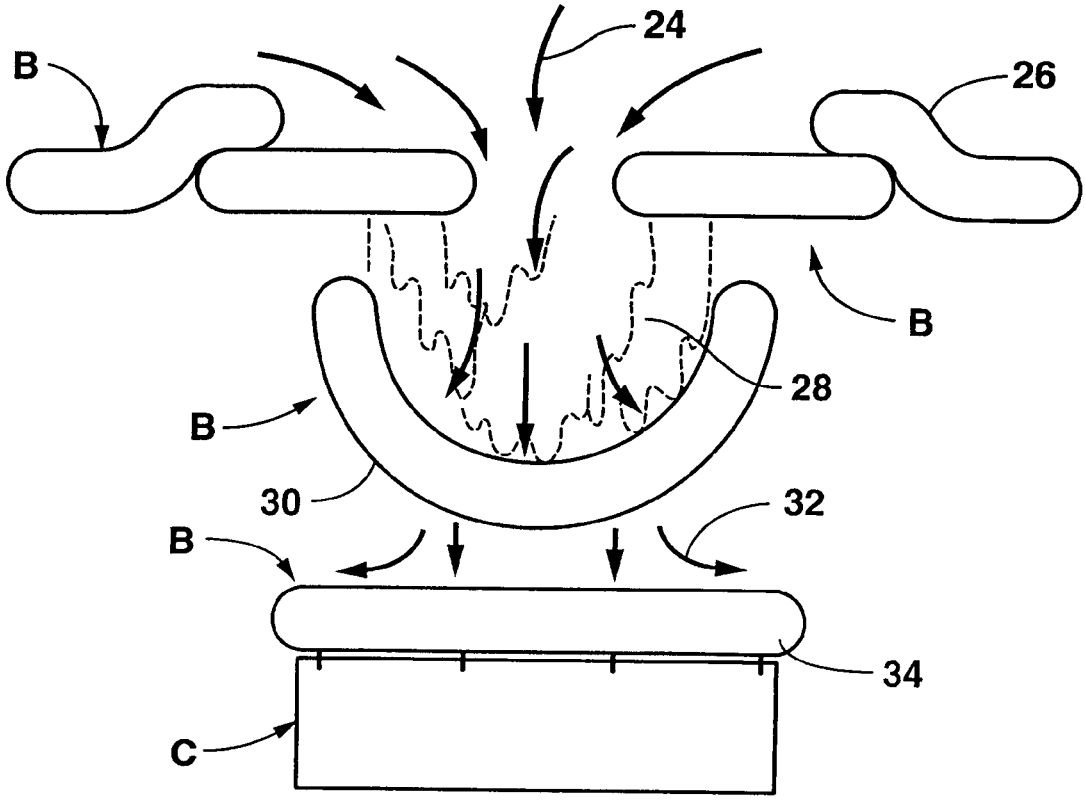
FIG. 6B is a schematic illustration of another application of the invention for channeling and ponding, and filtering water according to the invention.

FIGS. 6A and 6B show two examples of arrangements and systems of the present invention. FIG. 6A illustrates a filter bag surrounding a road curb drain wherein a filter bag B of sufficient length is placed to surround the drain to prevent the flow of sediment and other undesirable particles into the drain. FIG. 6B illustrates the versatility of the filter bags in an erosion control system wherein the plurality of filter bags B of different lengths are arranged to first channel the flow of water at 24 into a ponding area 28 formed by bag 28 wherein the water is allowed to form a pond where the settleable solids settle out of the water. As will be described in more detail, the filter fabric slows the flow of water effectively to form the pond and allow the solids to settle out as the water filters through the filter fabric and ballast before being disbursed by a final filter bag 34 and/or clarification skirt C may be provided on the down stream side of each filter bag as needed.

Figure 7A:
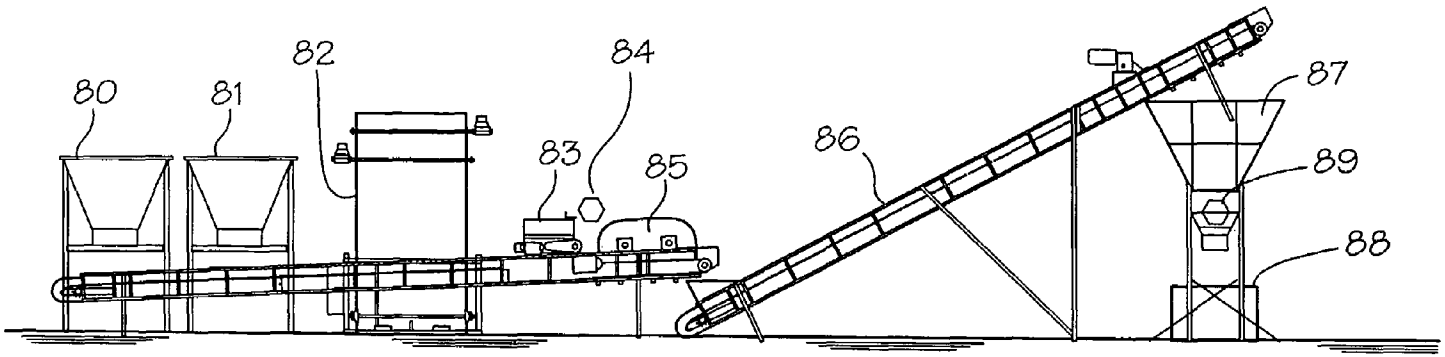
FIG. 7A is a side view of a schematic representation of equipment arranged to load filter bags of the present invention.
Figure 7B:
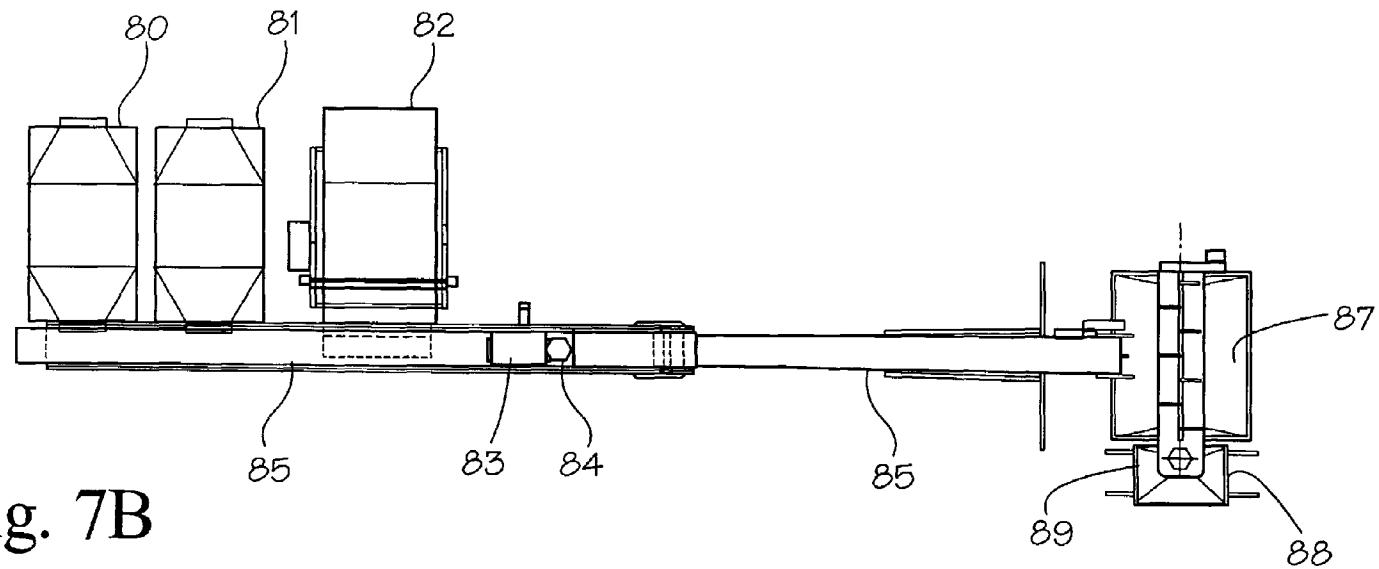
FIG. 7B is the top view of the equipment layout of FIG. 7B.

As can best be seen in FIGS. 7A and 7B, a process for preparing erosion control bags is illustrated wherein a special blend of water-soluble anionic polyacrylamide (PAM) dry powder agent is blended with the ballast materials to form the mixture to fill filter bag B. The filling is best done in a production line setting where the mixing of ingredients can be thoroughly accomplished and the mixture is agitated so that it is flowable by gravity feed through a chute into a bag rather than being blown or sprayed into a bag. The process shown in FIGS. 7A and 7B and described in this paragraph and in the two paragraphs below is the best mode for making the filled bags of EROSION EEL™ product of the present invention.

Referring to FIGS. 7A and 7B together, raw materials are placed into each of four holding bins as follows: Hopper 80 holds organic hardwood chips, straw, cocoa shells, ground corn cobs, or cotton seed hulls; hopper 81 holds recycled shredded rubber; hopper 82, also identified as a "Bale Processing Unit" holds synthetic or organic fibers, and hopper 83, also identified as the "Chemical Hopper" holds a chemical powder preferably PAM and/or any other chemical additives that might be desirable.

Specified amounts by volume of wood chips, shredded rubber, synthetic recycled carpet fibers, straw, cocoa shells, ground corn cobs, or cotton seed hulls are deposited in pre-set amounts from hopper 80 onto the continuously moving mixing conveyor 85. As the mixing conveyor moves under hopper 81 a pre-set amount of shredded rubber is deposited onto of the ingredients previously deposited from hopper 80. As the mixing conveyor moves under the bale processing unit 82, synthetic carpet fibers, if included in the mix, are deposited in a pre-set amount on top of the previously deposited ingredients. As the ingredients from hopper 80, hopper 81, and the bale processing unit 82 move under the chemical hopper 83, a pre-set amount of PAM is deposited onto the previously deposited ingredients. From chemical hopper 83 the combined raw materials are thoroughly mixed in the mixing conveyor 85. As the mixed filler ingredients leave the mixing conveyor 85, they are deposited by gravity onto incline conveyor 86 which transports them into bagging unit hopper 87. Ingredients are agitated by the settling device 89 and flow freely into the geo-textile tube attached at the bottom of bagging unit hopper 87. Dust controller 88 reduces and collects particles that are made airborne by the process. Filled bags are manually released from the bagging unit, are manually tied and dropped to the bagging facility floor.

Figure 8:
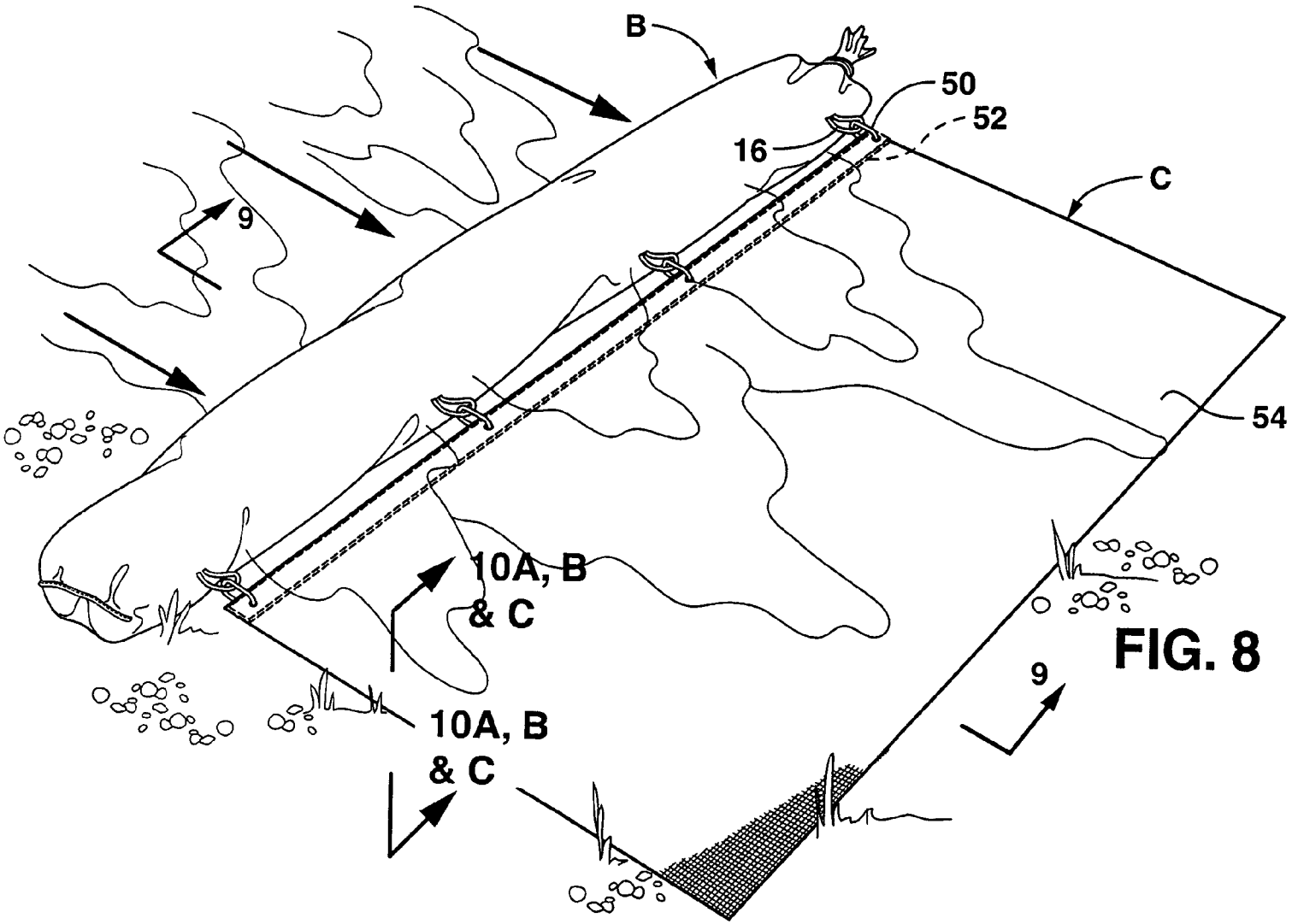
FIG. 8 is a perspective view illustrating a polymer filtration system and method for erosion control and water clarification according to the invention wherein a water clarification skirt impregnated with a polymer material is added to the filter bag for agglomeration and precipitation of particulate matter is the water stream.
Figure 10A:
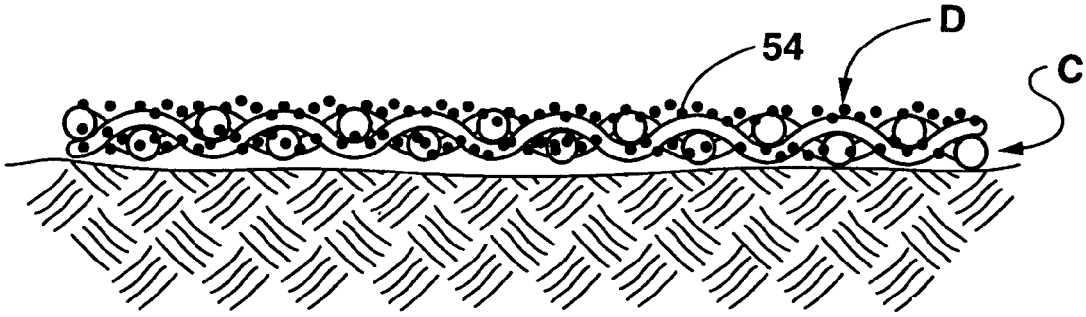
FIGS. 10A, 10B, and 10C are sectional views taken along lines 10A-10A, 10B-10B, and 10C-10C of FIG. 8 illustrating the agglomeration process taking place at the filter skirt.
Figure 10B:
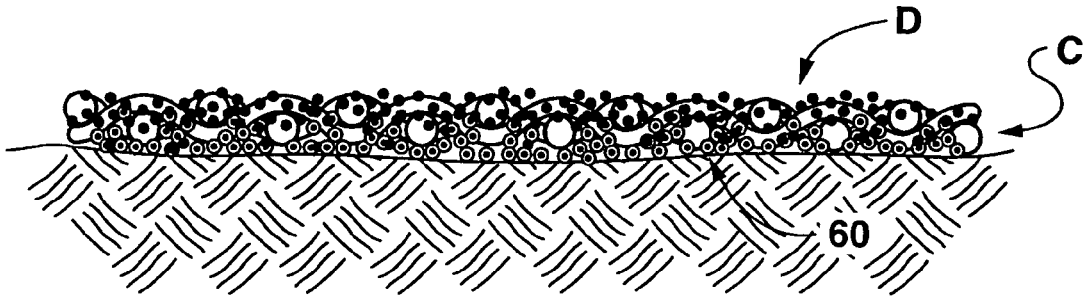
Figure 10C:
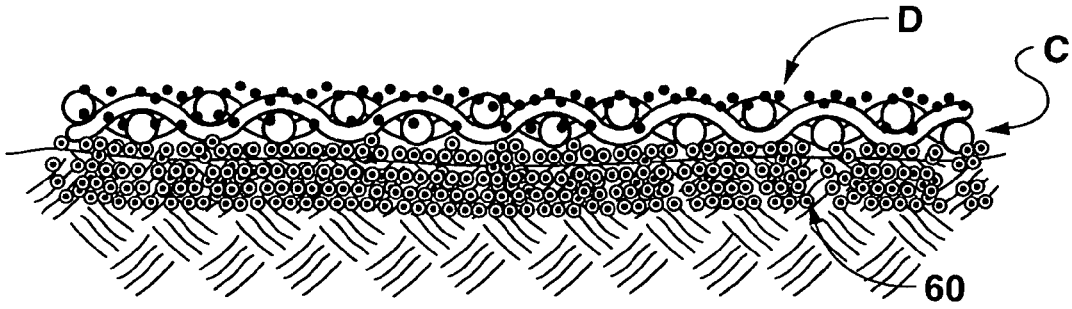

FIG. 8 illustrates another embodiment of treating the filtered water with PAM to agglomerate and precipitate colloidal particles out of the water. As can best be seen in FIG. 8, filter bag B includes a down stream water clarification skirt C fixed to the bag in any suitable manner such as links 50 connected to straps 16 of the bag. A stiffener strip 52 which extends the length of the skirt is connected to the links and tends to hold this side of the skirt flat against the ground. Preferably the length of the filter bag and the length of the skirt are generally the same. The width of the skirt may be any suitable width such as one, two, or three feet, or other widths depending on the application being made. The skirt is preferably formed of an organic material such as jute, cellulose, or the like. The skirt may be woven, non-woven, or knitted. Most importantly, the skirt is embedded, impregnated, coated, lightly adhered with, or otherwise provided with PAM. Preferably, the PAM agent is not too securely embedded in the skirt material so that it can be contacted by the water that flows thorough the skirt to agglomerate with the colloidal particles which will settle out on the site. In one aspect, grass seed may be included in the skirt. This process can best be seen in FIGS. 10A, 10B and 10C. FIG. 10A illustrates how the PAM agent D is carried in and on the fabric 54 of skirt C. The fabric may be multilayer with the PAM agent sandwiched between layers or the surface of the fabric coated with a water soluble adhesive to adhere PAM thereto initially. FIG. 10B illustrates the agglomeration step wherein the suspended colloidal particles in the water are agglomerated to form agglomerated particles, generally designated as 60. Eventually, the agglomerated particles separate and leave remaining PAM agent D while the agglomerated particles soak into the ground. While it is preferred that the skirt be attached to the bag for secure anchorage and positioning, the skirt could be staked in position. However, the skirt alone without attachment can be staked in position. In any event, it is important that the position of the skirt below and in close proximity to the bag be maintained.

FIG. 9A illustrates the system as a 3-phase or three step method for controlling erosion and clarifying storm water run-off. The first phase, Phase I, is a ponding phase that occurs upstream of filter bag B. In this phase, the water and sediment flow is slowed to a "ponding" state by the damming effect of bag B that allows settling of those solids 66 which can and will settle out of water pond 68 into the ground. In addition, the particles that are too large to pass through the material of bag B will be "filtered out" before entering the bag. The second phase, Phase II, is the filter and agglomeration phase. In this phase the matter 70 which does not settle during the ponding phase is considered to be colloidal, and is agglomerated through the introduction of the PAM agent in the interior of filter bag B. The anionic colloidal particulate matter is agglomerated by the presence of anionic PAM. When enough agglomeration occurs the agglomerated masses 72 become heavy enough to settle out the bag or be trapped by the filter fabric. The third phase, Phase III, is an agglomeration phase wherein the particles 74 which do not agglomerate in Phase II encounter the water clarification skirt as described above. In this phase, particles 74 encounter PAM agent D carried by skirt C, which acts like a blanket of PAM, and are caused to agglomerate through and under the skirt until the masses 60 soak into the ground. Thus, in addition to providing an agglomeration medium, the skirt tends to further retard the velocity of the water and check any flow streams that may have developed around or under the bag. A high degree of water clarity is achieved for the water runoff with the end result of a higher effluent quality which is safe to flow into streams and rivers. The settled particle or "floc" improve soil quality and tend to further reduce storm water run off.

FIG. 5B as mentioned above and FIG. 9B show a method and configuration for stabilizing a bag and skirt on a sloping surface by partially wrapping the skirt around the bag. This configuration keeps the skirt securely in place and adds a layer of agglomerating and filtering material to the system where the water flow is greatest.

The best mode of the invention which, in one aspect, is the complete erosion control system including the selection of the appropriate ballast mix, making the filter bags and properly placing them on a sloping surface that is subject to erosion. The best mode process for making the erosion control bag product has been described above in connection with FIGS. 7A and 7B. The best mode construction of a filter bag is shown in FIGS. 2 and 3 where the bag is a twill weave polypropylene with UV inhibitor and flame retardants having a 9½" diameter with the bag interior charged with PAM in the range of 20 to 200 gms per bag with the preferred charge being 20 to 30 gms/bag. In general, the concentration of PAM will conform to local, state and Federal guidelines and regulations for its use. The fabric is in the range of 3 to 16 oz/yd with sieve size from No. 10 to No. 100. The ballast is filled with, by equal volume, chopped nylon fibers, chopped tire rubber, and mulch. The best mode bag length is about 116" with a filled bag weighing in the range of 120 to 125 pounds. It should be understood that the bags and ballast are site specific and will be tailored according to each location.

While a preferred embodiment of the invention has been described using specific terms, such description is for illustrative purposes only, and it is to be understood that changes and variations may be made without departing from the spirit or scope of the following claims.

What is claimed is:

1. A water filtration and erosion control system comprising:

a) at least one filter bag positioned on a surface to control the flow of water thereacross; said bag comprising:

i) an elongated, tubular filter bag having a wall constructed from a fabric, said fabric performing filtration of surface water passing therethrough said fabric being woven from polypropylene or polyethylene and having weight in the range from about 3 oz/yd to 16 oz/yd and a sieve size in the range from No. 10 to No. 100;

ii) ballast being disposed within said filter bag to filter water passing through the bag, said ballast substantially filling said bag to provide sufficient weight to restrain the filter bag's movement when placed on a sloping surface across which water may flow, said filter bag being capable of at least partially damming such water flow before said water passes through said filter bag, said ballast comprising a material selected from the group consisting of chopped rubber, shredded rubber, and ground rubber, and combinations thereof and said ballast including an effective amount of water soluble anionic polyacrylamide flocculant for erosion control;

iii) said fabric including a UV inhibitor; and, iv) said filter bags being portable.

2. The system of claim 1 wherein the ballast in said filter bag comprises chopped rubber thereof.

3. A water filtration and erosion control system comprising:

a) an elongated filter bag having a wall constructed from a polymeric fabric, said fabric filtering surface water passing into and out of said bag;

b) material distributed within said filter bag for agglomerating colloidally suspended particles in water passing through said filter bag whereby said agglomerated particles settle within said filter bag, are removed by filtration in the fabric wall, or pass through said fabric said material including an effective amount of water soluble anionic polyacrylamide flocculant for erosion control; and c) ballast being disposed within said filter bag with said agglomerating material to filter water passing through the bag, said ballast substantially filling said bag with sufficient weight to restrain its movement when placed on a sloping surface across which water may flow, said filter bag at least partially damming such water flow before said water passing through said filter bag, said ballast comprising a material selected from the group consisting of chopped rubber, shredded rubber, and ground rubber.

4. The system of claim 3 wherein at least one strap is attached to the filter bag exterior surface.

5. The system of claim 3 wherein said filter bag includes a radio frequency identification device.

6. The system of claim 3 wherein the ballast is selected from the group consisting of shredded and chopped rubber, and combinations thereof.

7. The system of claim 3 wherein the filter bag fabric is woven polypropylene or polyethylene.

8. The system of claim 7 wherein the agglomerating material is positioned at the bottom of a filter bag beneath ballast material.

9. The system of claim 8 including a plurality of the filter bags stacked one upon another.

10. The system of claim 3 wherein the filter bag is tubular in shape and the diameter of said tubular filter bag is in the range from about 8" to about 12".

11. The system of claim 3 wherein the filter bag material includes a flame retardant.

12. The system of claim 3 wherein the fabric comprises a polymeric material having a UV inhibitor incorporated therein.

13. The system of claim 3 wherein the ballast material consists essentially of chopped rubber.

* * * * *